United States Patent [19]

Bennitt

[11] Patent Number: 5,011,383

[45] Date of Patent: Apr. 30, 1991

[54] VALVE ASSEMBLY, FOR USE IN COMBINATION WITH A STRAIGHT-CYLINDER, GAS-COMPRESSION CHAMBER, AND IN COMBINATION THEREWITH

[75] Inventor: Robert A. Bennitt, Painted Post, N.Y.

[73] Assignee: Dresser-Rand Company, Corning, N.Y.

[21] Appl. No.: 459,482

[22] Filed: Jan. 2, 1990

[51] Int. Cl.[5] ..... F04B 21/02

[52] U.S. Cl. ..... 417/534; 417/524; 417/526; 417/570; 137/516.15

[58] Field of Search ..... 417/534, 526, 525, 524, 417/570; 137/516.15

[56] References Cited

U.S. PATENT DOCUMENTS

| | | | |
|---|---|---|---|
| 658,325 | 9/1900 | Stukes et al. | 417/525 |
| 1,762,625 | 6/1930 | Holt | 417/525 |
| 1,887,886 | 11/1932 | Grant | 417/526 |
| 1,952,640 | 3/1924 | Ventress et al. | 417/525 |
| 3,032,060 | 5/1962 | Huffman | 137/516.15 |
| 4,867,200 | 9/1989 | Markley | 137/516.15 |

*Primary Examiner*—Michael Koczo

*Assistant Examiner*—Michael Kocharov

*Attorney, Agent, or Firm*—Bernard J. Murphy

[57] ABSTRACT

The assembly, designed for use in combination with a straight-cylinder, gas-compression chamber, has a center bolt which is threaded at opposite ends thereof to receive a pair of valve sets. Each of the latter has a ported valve seat, valve guard, and ported valve plate. The guard is set about the bolt, and against a shoulder formed on the bolt therefor. The seat is centrally threaded, to engage one of the threaded ends of the bolt, and it and the guard confine the valve plate therebetween. In that one of the valve sets is turned 180° from the other, i.e., the two guards being in confrontation, and the two seats remotely disposed, vis-a-vis, the one valve set is open to fluid flow, while the other is closed, as the assembly is reciprocated in such a straight-cylinder, chamber. Identical valve sets, on different, short bolts set in end closures of such a chamber, serve as gas inlet valves, while the reciprocable assembly carries the discharge valves. The invention obviates any need for pistons, per se as, according to a feature of the invention, the valve sets carry replaceable sealing (viz., piston rings).

12 Claims, 4 Drawing Sheets

33
34a
32a
34a
32b
36
44
52
44
52
60
38
58
50
42
54
40
54
46
48
66
66
68
68
56

VALVE ASSEMBLY, FOR USE IN COMBINATION WITH A STRAIGHT-CYLINDER, GAS-COMPRESSION CHAMBER, AND IN COMBINATION THEREWITH

This invention pertains to valves, i.e., gas-control valves, and valve assemblies for use in, and in combination with, straight-cylinder, gas-compression chambers, and in particular to such valves and valve assemblies in which the same are configured for confinement within such straight-cylinder, gas compression chambers, but one configuration of valve serves for either gas inlet or gas discharge, and said one valve configuration is piston-ringed in order that the same serves as well as a gas-compressing piston when reciprocably disposed within such an aforesaid cylinder.

Prior art gas compressors, typically, employ both inlet and discharge valves, and gas compressing pistons, and commonly the valves are externally mounted to the gas-compression chamber.

It is an object of this invention to set forth a novel valve assembly, for use in combination with a straight-cylinder, gas-compression chamber, which obviates any need for gas-compressing pistons.

It is also an object of this invention to disclose a gas control valve, in combination with a straight cylinder, gas compression chamber, which serves as either gas inlet or gas discharge, and which is piston-ringed, or otherwise peripherally sealed with replaceable seals, to function as a gas compressing piston.

Particularly is it an object of this invention to set forth, in combination with a straight-cylinder, gas-compression chamber having centrally-threaded, end closures, a gas control valve, comprising a ported, valve seat; a ported, valve guard; a ported valve plate interposed between said seat and guard; and a bolt, for mounting of said seat, guard and plate thereon, having (a) external threads formed thereon, and (b) an annular shoulder formed thereabout; wherein said seat, guard and plate are centrally apertured; said guard is set about said bolt, and against said shoulder; said seat is (a) internally threaded, (b) threadedly engaged with said bolt threads, and (c) has replaceable sealing means engaged with the periphery thereof; and said valve is reciprocably confined within, and sealingly engaged with the inner surface of, said gas compression chamber.

Another object of this invention is to set forth, in combination with a straight cylinder, gas compression chamber having centrally-threaded, end closures, a gas-control valve, comprising a ported, valve seat; a ported, valve guard; a ported, valve plate interposed between said seat and said guard; and a bolt, for mounting of said seat, guard and plate thereon, having (a) external threads formed thereon, and (b) an annular shoulder formed thereabout; wherein said seat, guard, and plate are centrally apertured; said guard is set about said bolt, and against said shoulder; said seat is (a) internally threaded, (b) threadedly engaged with said bolt threads, and (c) has replaceable sealing means engaged with the periphery thereof; and said valve is confined within said gas compression chamber, sealingly engaged with the inner surface of said chamber, and said bolt is threadedly engaged with one of the centrally-threaded end closures of said chamber.

Yet another object of this invention is to disclose a valve assembly, for use in combination with a straight-cylinder, gas-compression chamber, comprising a bolt; said bolt having (a) external threads formed thereon at opposite ends thereof, and (b) annular shoulders formed thereabout, intermediate said threaded, opposite ends; a pair of ported, valve seats; a pair of ported, valve guards; and a pair of ported, valve plates; wherein each seat and guard has one of said valve plates interposed therebetween; said seats, guards and valve plates are centrally apertured; each guard is set about said bolt, and against one of said shoulders; and each seat is (a) internally threaded, (b) threadedly engaged with one of said opposite ends of said bolt, and (c) has replaceable sealing means engaged with the periphery thereof.

Further objects of this invention, as well as the novel features thereof, will become more apparent by reference to the following description, taken in conjunction with the accompanying figures, in which.

Figure 2:
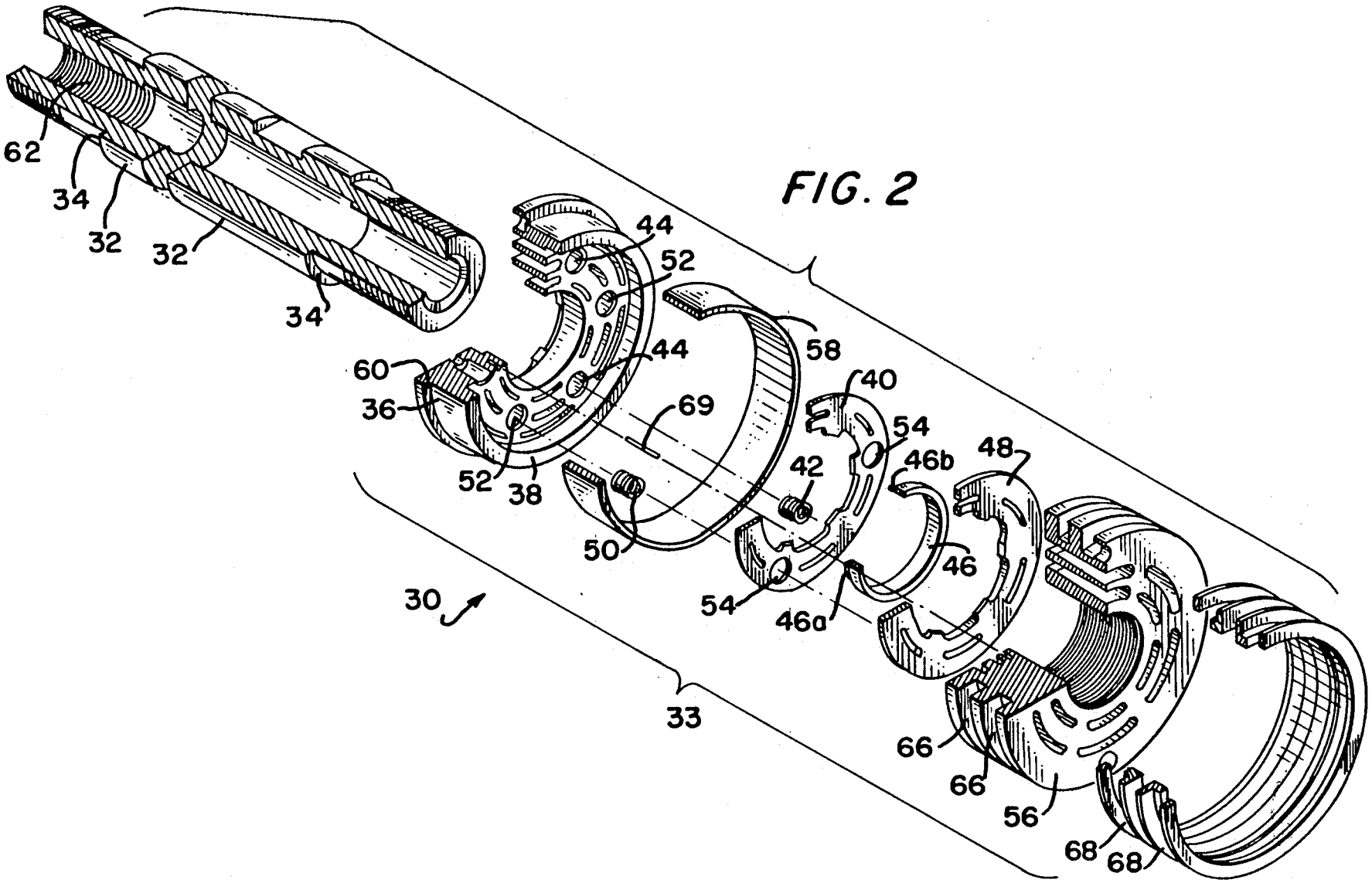
FIG. 2 is a perspective, exploded view of the novel valve assembly, albeit showing but one of the two discharge valves thereof.
Figures 3A, 3B:
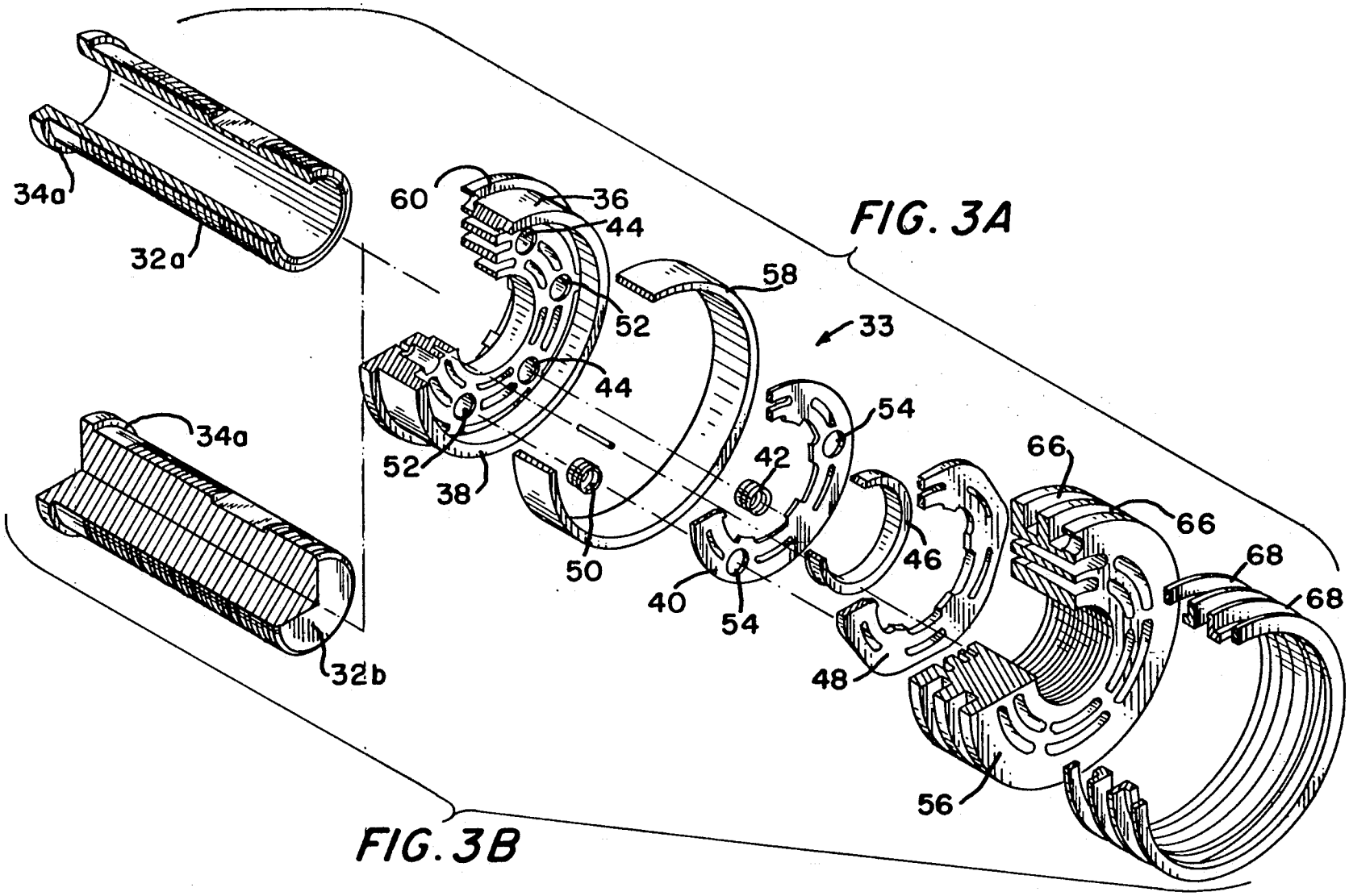
FIG. 3A is a perspective, exploded view of one of the inlet gas control valves.
Figure 4:
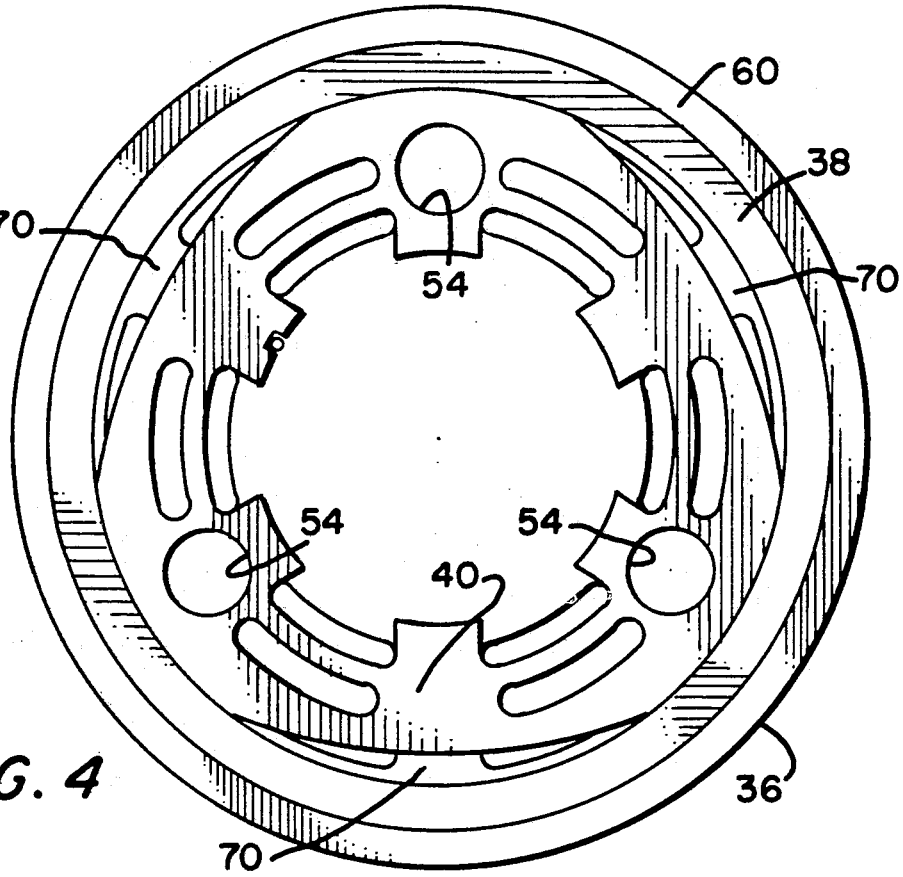
Figure 5:
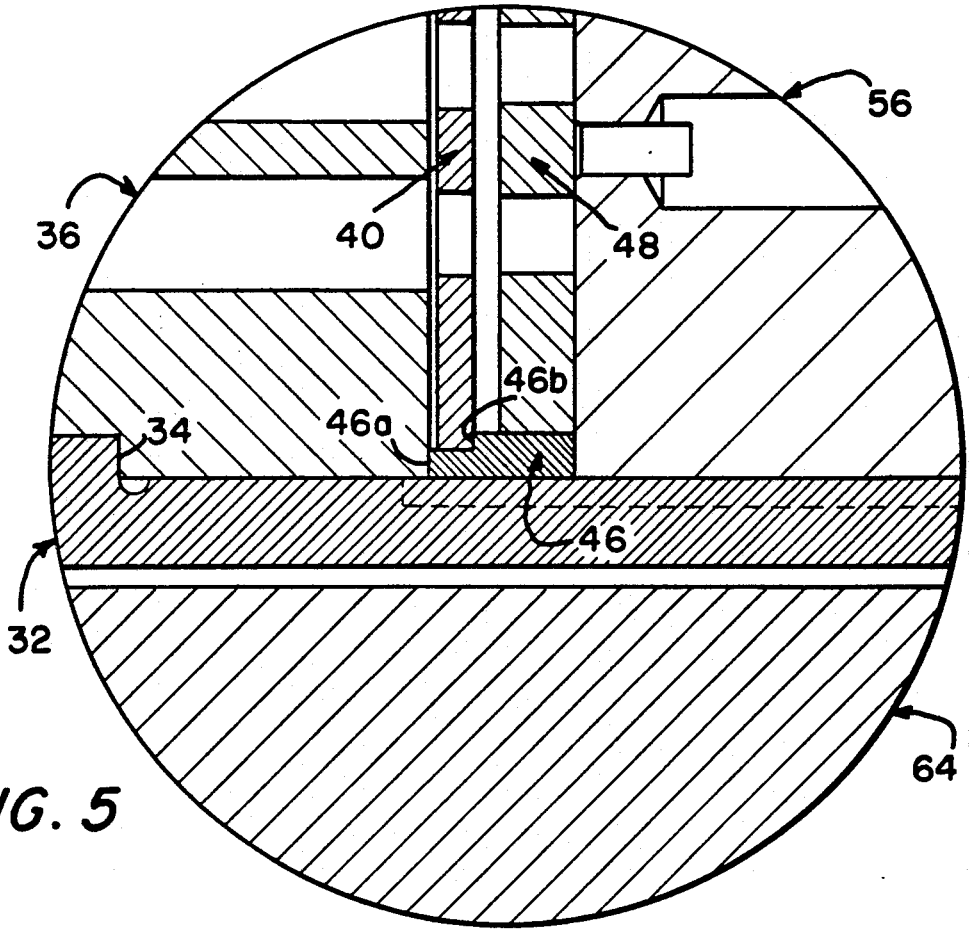

FIG. 3B shares the view of FIG. 3A, representing the other of the inlet gas-control valves; FIGS. 2, 3A and 3B also being partially cross-sectioned;

FIG. 4 is a plan view of the valve plate and dampening plate of the novel valve; and FIG. 5 is an enlarged, cross-sectional view, taken through a limited, center portion of a discharge valve.

Figure 1:
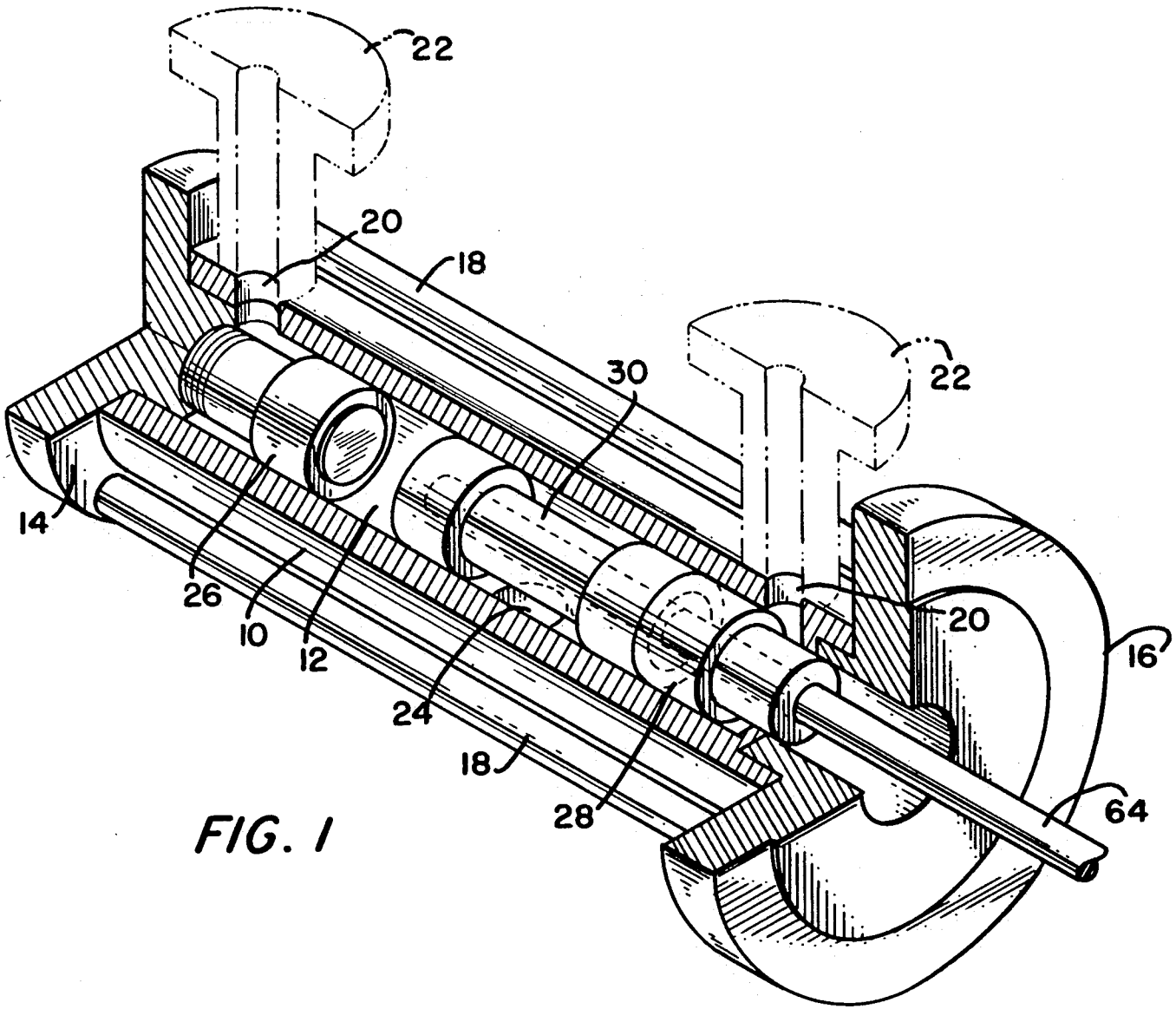
FIG. 1 is a perspective, partially cross-sectioned illustration of a straight-cylinder, gas-compression chamber, in which the novel valves and valve assembly are confined.

As shown in FIG. 1, a straight cylinder 10 defines therewithin a gas-compression chamber 12. Ends of the cylinder have centrally-threaded end closures 14 and 16. The end closures are held fast to the ends of the cylinder 10 by means of tie bolts 18 (only two thereof being visible). The cylinder 10 has gas inlet ports 20 formed therein for admission of gas via inlet conduits 22 (shown only in phantom). The cylinder also has a gas discharge port 24 formed therein intermediate the ends thereof.

End closure 14 threadedly receives the central bolt of an inlet valve 26, whereas end closure 16 threadedly receives the central bolt of an inlet valve 28. Therebetween, reciprocably mounted within the chamber 12, is the novel valve assembly 30.

FIG. 2 shows valve assembly 30 in greatly enlarged detail. It comprises a bolt 32 which is hollow, and which has external threads formed thereon at opposite ends thereof. The assembly comprises a pair of valve sets 33; as one is identical to the other, only one such set is shown. The bolt 32 has shoulders 34 formed thereabout, and spaced apart, adjacent to the opposite ends thereof. Assembled, each shoulder 34 receives a ported, valve guard 36 thereagainst, the guard being centrally apertured. The guard 36 has a peripheral wall 38 in which is received a dampening plate 40. Compression springs 42, which are nested in blind holes 44 formed in the guard 38, bear against the underside of the dampening plate. A guide ring 46 which has a reduced diameter portion **46*a* at one end thereof, is received in the apertured center of the dampening plate 40. Ring 46 is provided to limit the lift of the dampening plate 40. Set about the bolt 32 is a valve plate 48, it too being centrally apertured, slidably to receive the guide ring therewithin. Compression springs 50, which also are nested in blind holes 52 formed in the guard 36, are in penetration of holes 54 formed therefor in the dampening plate 40, and bias the valve plate 48 away from the guard 38. The damping plate 40, biased away from the guard 36 by the springs 42, cooperates with the springs 50 to dampen an impact of the valve plate 48 with the guard 36. Plate 40 intercepts plate 48 when the latter closes toward guard 36. A centrally apertured and threaded valve seat 56 is threadedly engaged with the threads at one end of the bolt 32. With its threaded engagement with the bolt 32, the seat 56 clamps together the guard 36, plate 40, guide ring 46, and valve plate 48; too, it holds in position a rider ring 58 which is set about the wall 38 and against a lip 60 which circumscribes the guard 36**.

The guide ring 46 keeps the dampening plate 40 distanced from the valve seat 56, however the plate 48 freely translates along the outer surface of the ring 46. The ring 46 sets against the seat 56 at one end thereof, and the opposite end of ring 46 sets against the guard 36. An outer shoulder **46*b*, formed on the ring 46, limits a lift of the plate 40 to the minimal depth of the reduced diameter portion 46*a*, in that the plate 40 closes against the shoulder 46*b***.

As is quite conventional, and as can be seen in the figure, the guard 36, dampening plate 40 and valve plate 48, have mutually aligned ports formed therein to permit the flow of gas directly therethrough. The valve seat 56, too, is ported; however the ports therein are not in alignment with the ports in the guard 36, plate 40, and plate 48. Rather, the ports in valve seat 56 are occluded in plate 48. Plate 48 must remove from the seat 56 to permit fluid flow through the seat 56. When assembly 30 translates to the right (with reference to FIG. 1) a gas pressure, built up in the chamber 12 between assembly 30 and inlet valve 28, causes plate 48 to remove from the seat 56; this allows the pressured gas to pass through the aforesaid porting in plate 48, plate 40, and guard 36 for exit thereof through the discharge port 24. When the assembly 30 translates to the left (FIG. 1), the plate 48 closes against seat 56 and, consequently, a vacuum pressure is created between assembly 30 and inlet valve 28; this causes an ingestion of gas, via port 20, into chamber 12.

Valve assembly 30, with both valve sets 33 emplaced thereon, is reciprocable in chamber 12 and, consequently, one of the sets 33 is closed while the other is open to the flow therethrough of gas. Bolt 32 is internally threaded, at 62, threadedly to receive the threaded end of a piston rod 64. The latter is so-called in that the valve assembly 30 functions as a dual-headed piston. The valve seat 56 has a pair of grooves 66 formed therein and thereabout. The grooves 66 receive piston rings 68 therein to effect a sealing engagement thereof with the inner surface of the chamber 12. By this expedient, with identical valve sets 33 on opposite ends of the bolt 32, the valve sets serve as the pistons, and are wholly confined within the chamber, functioning as well as the discharge valves. An alignment pin 69 is received in holes provided therefor in guard 36 and seat 56, at ends of the pin 69, and the pin penetrates the plates 40 and 48, to keep all cited components properly aligned.

In FIGS. 3A and 3B, same or similar index numbers, as those shown in FIGS. 1 and 2, denote same or similar elements.

FIG. 3A depicts an inlet valve which is received in the end closure 16, and it is identical, in all respects except one, to valve set(s) 33 of FIG. 2. Instead of bolt 32, it has a bolt **32*a*. The latter is of short length and is hollow. The hollow interior accommodates the reciprocation of the piston rod 64. The porting of the components therein is such, and again, identical to valve set(s) 33, to close against the flow of gas therethrough as the valve assembly 30** approaches it, and to open as the valve assembly moves away therefrom.

In FIG. 3B is depicted another inlet valve, albeit the one received in the end closure 14. Save for the central bolt **34*b*, it too is identical to valve set(s) 33. Whereas bolt 32*a* of FIG. 3A is hollow to receive the piston rod 64, bolt 34*b* is of solid cross-section. For simplicity, FIGS. 3A and 3B share the depiction of the components of each inlet valve, the only differences therebetween reside in the center bolts 32*a* (FIG. 3A) and 32*b* (FIG. 3B**), because they are otherwise identical.

FIG. 4 illustrates a particularly novel feature of the valve sets 33, the same being a plan view of the dampening plate 40 and valve guard 36. The inner periphery of the wall 38 is truly circular, whereas the confronting periphery of the dampening plate is trochoidal. Consequently, chordal voids 70 are formed between the aforesaid peripheries to enhance gas flow therethrough. The voids 70 present large, open areas, between the peripheral wall 38 of guard 36 and the plate 40, to allow gas to course freely therethrough into the outermost ports in guard 36. The trochoidal configuration of the dampening plate 40 defines portions of the plate 40 with relatively narrow and wide sectors. The holes 54, provided in plate 40 for the springs 50, are formed in the wider sectors of the plate, as shown in FIG. 4.

While I have described my invention in connection with specific embodiments thereof, it is to be clearly understood that this is done only by way of example, and not as a limitation to the scope of my invention, as set forth in the objects thereof, and in the appended claims.

I claim:

1. In combination with a straight-cylinder, gas compression chamber having end closures, a gas-control valve, comprising:

a ported valve seat;

a ported valve guard;

a ported valve plate interposed between said seat and guard; and a bolt, for mounting of said seat, guard and plate thereon, having (a) external threads formed thereon, and (b) an annular shoulder formed thereabout; wherein said seat, guard, and plate are centrally apertured;

said guard is set about said bolt; and against said shoulder;

said seat is internally threaded, (b) threadedly engaged with said bolt threads, and (c) has replaceable sealing means engaged with the periphery thereof;

said valve is reciprocably confined within, and sealingly engaged with the inner surface of, said gas-compression chamber;

said seat and guard are circular; and including a dampening plate interposed between said valve plate and said valve guard; and wherein said valve guard and said dampening plate have mutually confronting, peripheral surfaces;

said peripheral surface of said guard is circular; and said peripheral surface of said dampening plate is trochoidal.

2. In combination with a straight-cylinder, gas compression chamber having centrally-threaded, end closures, a gas-control valve, comprising;

a ported, valve seat;

a ported, valve guard;

a ported, valve plate interposed between said seat and guard; and a bolt, for mounting of said seat, guard and plate thereon, having (a) external threads formed thereon, and (b) an annular shoulder formed thereabout; wherein said seat, guard, and plate are centrally apertured;

said guard is set about said bolt, and against said shoulder;

said seat is (a) internally threaded, (b) threadedly engaged with said bolt threads. and (c) has replaceable sealing means engaged with the periphery thereof; and said valve is confined within said gas-compression chamber, sealingly engaged with the inner surface of said chamber, and said bolt is threadedly engaged with one of the centrally-threaded end closures of said chamber.

3. A gas-control valve, according to claim 1, wherein:

said valve seat has a plurality of grooves formed therein and about the periphery thereof; and said sealing means comprises piston rings set in said grooves.

4. A gas control valve, according to claim 1, wherein:

said bolt is hollow.

5. A gas control valve, according to claim 1, wherein:

said bolt is hollow, and has internal threads formed therein.

6. A gas control valve, according to claim 5, further including:

a piston rod, threaded at an end thereof, threadedly engaged with said internal threads of said hollow bolt, and in penetration of one of said end closures of said chamber.

7. A gas control valve, according to claim 2, wherein:

said bolt is hollow.

8. A gas control valve, according to claim 2, wherein:

said bolt is solid in cross-section.

9. A gas control valve, according to claim 1, further including:

means interposed between said valve guard and said valve plate biasing said valve plate toward said valve seat; and said biasing means are in penetration of said dampening plate.

10. A valve assembly, for use in combination with a straight-cylinder, gas-compression chamber, comprising:

a bolt;

said bolt having (a) external threads formed thereon at opposite ends thereof, and (b) annular shoulders formed thereabout, intermediate said threaded, opposite ends;

a pair of ported, valve seats;

a pair of ported, valve guards; and a pair of ported, valve plates; wherein each seat and guard has one of said valve plates interposed therebetween;

said seats, guards, and valve plates are centrally apertured;

each guard is set about said bolt; and against one of said shoulders; and each seat is (a) internally threaded, (b) threadedly engaged with one of said opposite ends of said bolt, and (c) has replaceable sealing means engaged with the periphery thereof; wherein said seats and guards are circular; and including a dampening plate interposed between each said valve plate and valve guard; and wherein each said valve guard and dampening plate have mutually confronting, peripheral surfaces;

said peripheral surface of each of said guards is circular; and said peripheral surface of each of said dampening plates is trochoidal.

11. A valve assembly, according to claim 10, wherein:

each of said seats has a plurality of grooves formed therein and about the periphery thereof; and said sealing means comprises piston rings set in said grooves.

12. A valve assembly, according to claim 10, wherein:

said bolt is hollow, and has threads formed therein.

* * * * *